US010100442B2

(12) United States Patent
Peulen

(10) Patent No.: US 10,100,442 B2
(45) Date of Patent: Oct. 16, 2018

(54) CIRCULAR COMB COMPRISING A GUIDE ELEMENT

(71) Applicant: Maschinenfabrik Rieter AG, Winterthur (CH)

(72) Inventor: Jacques Peulen, Rüti (CH)

(73) Assignee: Maschinenfabrik Rieter AG, Winterthur (CH)

( * ) Notice: Subject to any disclaimer, the term of this patent is extended or adjusted under 35 U.S.C. 154(b) by 313 days.

(21) Appl. No.: 14/972,231

(22) Filed: Dec. 17, 2015

(65) Prior Publication Data

US 2016/0177477 A1 Jun. 23, 2016

(30) Foreign Application Priority Data

Dec. 19, 2014 (CH) ..... 01987/14

(51) Int. Cl.
*D01G 19/10* (2006.01)

(52) U.S. Cl.
CPC ..... *D01G 19/105* (2013.01)

(58) Field of Classification Search
CPC ..... D01G 19/10; D01G 19/105
See application file for complete search history.

(56) References Cited

U.S. PATENT DOCUMENTS

| | | | | |
|---|---|---|---|---|
| 5,038,440 | A * | 8/1991 | Demuth | D01G 9/06 19/114 |
| 5,657,512 | A * | 8/1997 | Graf | D01G 19/105 19/122 |
| 6,353,974 | B1 * | 3/2002 | Graf | D01G 15/88 19/115 R |
| 2013/0263408 | A1 * | 10/2013 | Muller | D01G 19/105 19/234 |
| 2015/0167203 | A1 * | 6/2015 | Shimbara | D01G 19/105 19/233 |

FOREIGN PATENT DOCUMENTS

| | | | | |
|---|---|---|---|---|
| CH | 654 599 | | 2/1986 | |
| CH | 707 882 | | 10/2014 | |
| EP | 2426239 | A1 * | 3/2012 | D01G 19/105 |
| EP | 2789716 | A1 * | 10/2014 | D01G 19/105 |
| WO | WO 2012027852 | A1 * | 3/2012 | D01G 19/105 |

* cited by examiner

*Primary Examiner* — Shaun R Hurley
(74) *Attorney, Agent, or Firm* — Dority & Manning, P.A.

(57) ABSTRACT

A circular comb for a comber includes a basic body fastened on a shaft in a rotationally locked manner. A comb clothing is supported on an outer circumference of the basic body and includes clothing tips that define an outer enclosing circle. A guide element following the basic body viewed in a combing direction of the comb clothing includes a first guide surface that adjoins the basic body, is arranged within the enclosing circle, and has a radial clearance from the enclosing circle. The guide element includes a second guide surface that adjoins and forms an obtuse angle with the first guide surface. A length of the second guide surface is at least twice as great as a length of the first guide surface, as viewed in a circumferential direction of the circular comb.

12 Claims, 1 Drawing Sheet

CIRCULAR COMB COMPRISING A GUIDE ELEMENT

FIELD OF THE INVENTION

The invention relates to a circular comb for a comber having a basic body, which is fastened on a circular comb shaft in a rotationally locked manner and supports, on the outer circumference thereof, at least one comb clothing, the clothing tips of which form an outer enclosing circle. A guide element fastened on the circular comb is provided following—as viewed in the combing direction of the comb clothing—the basic body supporting the comb clothing. The guide element has at least two mutually adjacent guide surfaces, wherein the first guide surface, which adjoins the basic body, is arranged within the enclosing circle and with substantially consistent radial clearance from the enclosing circle, and the adjoining second guide surface forms an obtuse angle with the first guide surface.

BACKGROUND

Document CH-654 599 makes known an embodiment of a circular comb for a comber, wherein a part 27 (called a guide element) is installed following a comb clothing (a needle segment having comb needles) in order to narrow the gap between the circular comb and the lower nipper plate. In this connection, the circular comb is rotatably mounted within a suction channel, to which a vacuum is applied in order to suction out the extracted components. The purpose of the additionally installed guide element (part 27) is to prevent the end of the fibrous web, which has been fed back by the detaching rollers, from being lifted off the lower detaching roller by the suction airflow present in the suction channel before the piecing process takes place. Such a lifting of the end of the fibrous web before the joining of the extracted fiber tuft protruding from the nipper disrupts the downstream joining process (piecing process) and results in unclean and faulty splices (piecings). The solution proposed in CH-654 599 improves the previous embodiments in terms of disruptive suction airflows.

As is also found in the cited prior art, the additional guide element (part 27) can extend only around a certain rotation angle of the circular comb in order to prevent a collision with the lower nipper plate of the nipper unit, which pivots back and forth.

Due to the demand to operate the combers at continuously increasing nip rates, the requirements regarding the production of high quality piecings are also continuously increasing. That is, at high nip rates, unwanted airflows have an even greater effect on the piecing process. In addition, it is becoming increasingly difficult to hold the fed-back end of the fibrous web on the periphery of the lower detaching roller before the end of the extracted fiber tuft protruding from the nipper is placed onto the end of the fibrous web. Due to the higher rotational speeds of the rotating parts, such as the circular comb and the brush roller, and the faster movements of the remaining parts, such as, e.g., the nipper unit, the generated airflows also change in the region of the join between the nipper unit and the detaching rollers. That is, the known guide elements following the comb unit, in the current geometric shape, are no longer capable of controlling the airflows in the region of the join such that a non-disrupted joining (piecing) of the extracted fiber tuft end to the fed-back end of the fibrous web is ensured.

SUMMARY OF THE INVENTION

A problem addressed by the invention is therefore that of improving or optimizing and developing known guide elements on the circular comb such that these ensure the production of high-quality piecings on the comber also at high nip rates. Additional objects and advantages of the invention will be set forth in part in the following description, or may be obvious from the description, or may be learned through practice of the invention.

In order to solve this problem, it is proposed that the radial clearance of the first guide surface of the guide element from the enclosing circle is between 4-10 mm and the second guide surface forms an angle between 130°-170° with the first guide surface, wherein the rear end—as viewed in the combing direction of the comb clothing—of the second guide surface has a radial clearance between 8-18 mm from the enclosing circle of the comb clothing and the length of the second guide surface is at least twice as great as the length of the first guide surface, as viewed in the circumferential direction of the circular comb.

Due to this special geometry of the guide element, it is possible to control the airflows within the region between the nipper unit, the circular comb, and the detaching rollers such that the end of the fibrous web fed back for the subsequent piecing process is held on the periphery of the lower detaching roller, also at high nip rates, in order to place the extracted end of the fiber tuft exactly onto the end of the fibrous web.

Advantageously, it is proposed that the first guide surface has a length between 5-20 mm. It is therefore ensured that the guide element will not collide with the back-and-forth pivoting nipper and that a reduction of the gap between the lower nipper plate of the nipper and the guide element that is sufficient to control the airflows is still available.

It is also advantageous when the second guide surface has a length between 20-50 mm.

In addition, it is proposed that a radius between 5-15 mm is provided between the first and the second guide surface.

It is thereby ensured that the end of the fiber tuft emerging from the comb clothing can gently glide from the first guide surface onto the downstream second guide surface. By introducing a radius in this transition region, trailing edges for the air circulation are avoided, which can otherwise result in additional air turbulences.

Preferably, another embodiment is proposed, wherein a third guide surface adjoins the end of the second guide surface as viewed in the circumferential direction of the circular comb and forms an angle between 90°-120° with the second guide surface, and the end of the third guide surface points in the direction of the circular comb shaft.

In order to ensure that no trailing edges for the airflow occur, which can additionally generate air turbulences, it is also proposed that a gentle transition having a radius between 5-15 mm is provided between the second and the third guide surface.

In order to avoid acting too harshly upon the fibers of the fiber tuft presented for combing when these impact the comb clothing, another guide element is installed directly in front—as viewed in the combing direction—of the basic body supporting the comb clothing, said guide element having at least two mutually adjacent guide surfaces, wherein the first guide surface, which adjoins the basic body, is arranged within the enclosing circle and with a substantially consistent clearance between 4-10 mm from the enclosing circle and the adjoining second guide surface forms an obtuse angle between 130°-170° with the first guide surface, wherein the front end—as viewed in the combing direction of the comb clothing—of the second guide surface is located with a radial clearance between 8-18 mm from the enclosing circle of the comb clothing and the length of the second guide surface is at least twice as great as the length of the first guide surface, as viewed in the circumferential direction of the circular comb.

The length of the first guide surface can be between 5-20 mm. The length of the second guide surface can be between 20-50 mm.

By means of this additional guide element, which can have the same design as the guide element following the comb clothing, the fiber tuft is gently inserted into the comb segment, thereby causing less fiber damage.

It is also proposed that a third guide surface adjoins the end of the second guide surface of the circular comb, as viewed in the circumferential direction of the circular comb, and forms an angle between 90°-120° with the second guide surface, and the end of the third guide surface points in the direction of the circular comb shaft.

In order to avoid trailing edges for the airflow, it is also proposed that a radius between 5-15 mm be provided at the transition between the guide surfaces of the additional guide element.

The guide elements are preferably made from aluminum or a plastic. The use of fiber reinforced materials is therefore included.

The guide elements should be made substantially from material having a low specific weight so that the loads (e.g., centrifugal forces) acting on the circular comb can be held as low as possible.

The guide elements can be fastened on the circular comb in various manners, e.g., by means of screwing, bonding, welding, etc.

In order to prevent fibers from depositing on the particular guide element, the guide surfaces of the particular guide element have a surface to which fibers do not adhere. It is possible to provide the guide surfaces of the guide elements with coatings. These surfaces can therefore also be designed to have greater wear resistance.

In order to ensure simple production, the guide element is integrally connected to the basic body. As a result, the installation of the guide element on the circular comb is eliminated and transition edges, onto which fibers can deposit, are avoided.

BRIEF DESCRIPTION OF THE DRAWINGS

Further advantages of the invention are described in greater detail and illustrated with reference to the following exemplary embodiments, in which.

DETAILED DESCRIPTION

Figure 1:
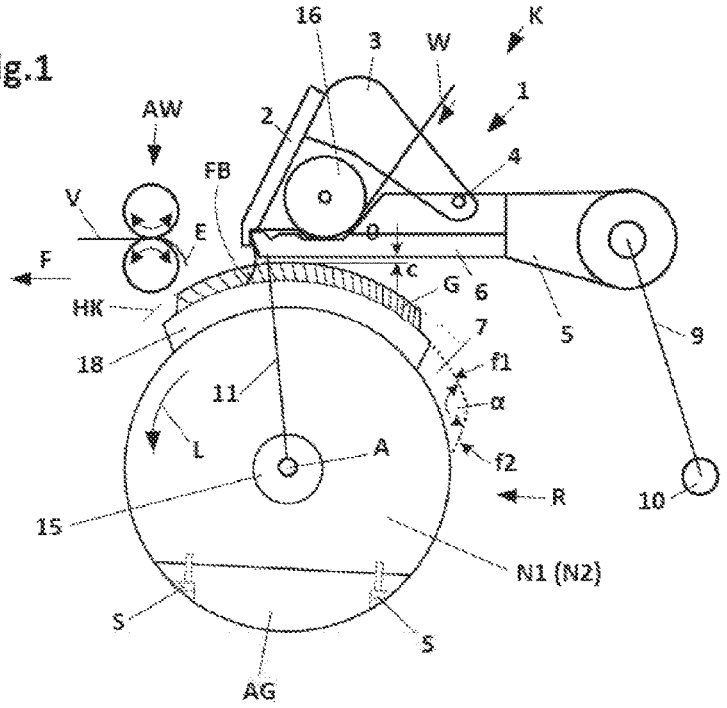
FIG. 1 shows a schematic side view of a combing head of a comber comprising a circular comb having a known design.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a schematic side view of a combing head K of a comber. In known combers, there are, e.g., eight such combing heads K arranged next to one another. The combing head K, of which only a portion of the elements is shown, comprises a nipper unit 1, which is mounted in the frame of the comber so as to be capable of pivoting back and forth about the axles 10, 15 via the pivoting arms 9, 11. The axle 10, which is also called a nipper shaft, is driven by a drive, which is not shown in greater detail, for imparting a back-and-forth motion to the nipper unit 1. The axle 15 is the circular comb shaft on which a circular comb R is fastened in a rotationally locked manner. The circular comb shaft 15 having the central axis A is also driven continuously or discontinuously by a non-illustrated drive. In the known solution, which is shown, the circular comb R, which is fastened on the circular comb shaft 15 underneath the nipper unit 1, comprises two hubs N1, N2, which are fixedly fastened on the circular comb shaft 15 so as to be spaced from each other and on the outer circumference of which a basic body 18 is fastened on one side and a mass balancing element AG is fastened on the other side. As schematically illustrated, the mass balancing element (referred to as a balancing element for short) is fastened via the screws S, via which this mass balancing element is fastened on the hubs N1, N2. The basic body 18 is also fixedly connected to the hubs N1, N2 via non-illustrated means. A clothing G is fastened above the basic body 18, which extends across the entire width B of the circular comb R, as does the balancing element AG. The clothing tips of the clothing G lie in an enclosing circle HK. In known combers, the angle at the circumference of the comb clothing G is between 90 and 130 degrees and is also referred to as the "comb angle".

Figure 3:
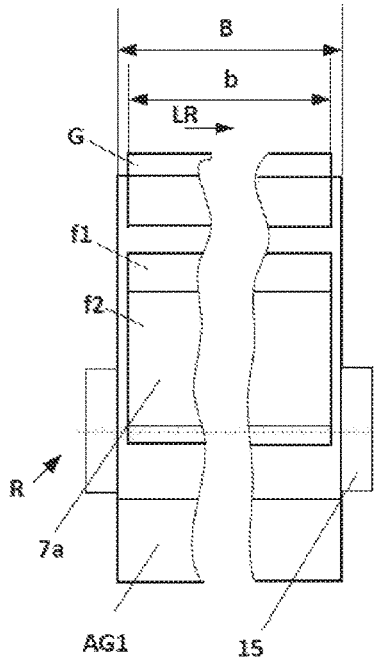
FIG. 3 shows a side view X according to FIG. 2.

In order to reduce the clearance between the lower nipper plate 6 and the circular comb R in a certain rotation-angle position of the circular comb, a guide element 7 is installed following the basic body 18, the guide element extending across nearly the entire width B (see FIG. 3) of the circular comb. The guide element 7 has a first guide surface f1, which directly adjoins the basic body 18 and extends with clearance from and approximately parallel to the enclosing circle HK. A second guide surface f2 adjoins the first guide surface f1 so as to form an obtuse angle $\alpha$.

Such a guide element, as shown in FIG. 1, is found in the published document CH-654 599, for example.

The nipper unit is formed by a nipper frame 5, on which a lower nipper plate 6 is fastened. An upper nipper plate 2 is mounted on the nipper frame 5 so as to be pivotable about a pivot axis 4 and pivoting arms 3. In the embodiment shown, the nipper unit 1 is closed, wherein the fiber tuft FB protruding from the clamping point of the nipper unit is captured and extracted by the clothing G. Non-illustrated loading means (e.g., springs) act on the pivoting arms 3, wherein said loading means control the pivoting movement of the upper nipper plate 2 and generate a necessary clamping force in the clamping point of the nipper unit 1. A feed roller 16 is also rotatably mounted in the nipper frame 5, above the lower nipper plate 6, the feed roller being driven in steps, e.g., by a non-illustrated ratchet drive. A lap W (or individual slivers), which is fed to the nipper unit 1, is fed to the clamping point of the nipper unit via this feed roller 16. After the fiber tuft FB has been extracted, the nipper unit 1 is pivoted in the direction of a downstream detaching roller pair AW. In this pivoting process, the nipper unit opens and the extracted end of the lap W or the fiber tuft FB is placed onto the end E of a previously formed fibrous web V and is pieced therewith by means of the effect of the clamping point of the detaching rollers AW, and is carried off in the conveyance direction F.

Figure 2:
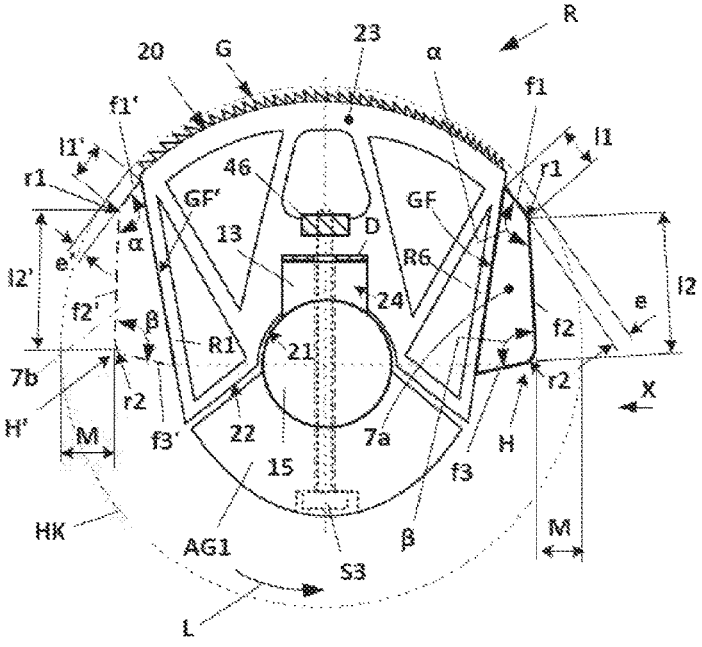
FIG. 2 shows a schematic side view of a circular comb having guide elements designed according to the invention.

FIG. 2 shows an exemplary embodiment of a circular comb R, which is designed according to the invention and has a guide element 7*a* (or 7*b*), wherein the basic body 20 shown here is designed as a hollow profile having a semi-circular trough 21, which is disposed opposite the circular comb shaft 15. A groove-shaped recess 24 is formed in the trough 21, within which a support element 13 is located.

Located between a support surface of the support element 13 and a base surface of the recess 24 is a replaceable spacer element D, by means of which the radius HR of the enclosing circle HK of the comb clothing G can be set or changed relative to the axle of the circular comb shaft 15. The objective is to set the clearance c (FIG. 1) to be as small as possible in order to obtain a complete comb out of the fiber tuft FB protruding from the nipper.

The trough 21, or the recess 24, is located on an inner section 22 of the basic body 20, on which an outer section 23 is supported via the ribs. Hollow spaces are formed between the ribs and the inner and the outer section 22, 23.

In order to fasten the basic body 20 with the support element 13 and a balancing element AG1 on the circular comb shaft 15, the shaft is provided with a plurality—as viewed along the width B of the circular comb R—of passage holes, through which screws S3 extend. The head of the particular screw S3 is located in a recess of the balancing element AG1. In addition, a passage hole, which is aligned with the bore of the circular comb shaft 15, is provided in the balancing element AG1. The support element 13, the spacer element D, and the basic body 20 are provided with passage holes, which are aligned with the bores of the circular comb shaft 15 and through which the particular screw S3 extends. The end of the particular screw S3 has a thread, which extends beyond the bore of the basic body 20 in the region of a hollow space. A nut 46 is installed on the thread. By tightening the screws S3 and screwing these into the threaded bore of the nut, the basic body 20 with the support element 13 and the balancing element AG1 are pressed against one another and are fixedly clamped on the shaft 15 and are fixed in position.

Additional details of this fastening and of the design of the basic body as a hollow profile can be found, e.g., in the published document CH-707882.

As also shown in FIG. 2, a guide element 7*a* is installed behind—as viewed in the combing direction L—a comb clothing G and following the outer section 23 of the basic body 20. The guide element 7*a* rests via a base surface GF on an inwardly protruding connecting piece R6 of the basic body 20 and is fixed in the position shown by means of non-illustrated fastening means. Fastenings can be implemented in this case by means of screws or rivets. The guide means can also be connected to the basic body via adhesives or via welded or soldered connections. It is also possible to design the guide element as one piece with the basic body. That is, the guide means 7*a* (or 7*b*) is integrated during the production of the basic body 20.

In the present example, the guide means 7*a* has a first guide surface f1, which can have a length l1 of 5 to 20 mm. The guide surface f1 extends with an approximately parallel clearance e of 4 to 10 mm from the outer enclosing circle HK of the comb clothing G. The first guide surface f1 adjoins a subsequent, second guide surface f2 so as to form an obtuse angle α between 130° and 160°. A radius r1 of 5 to 15 mm is provided at the transition between the first and the second guide surface. As a result, a gentle transition is created and a trailing edge is avoided, which can result in air vortices under certain circumstances. The end H of the second guide surface has a radial clearance M from the enclosing circle HK between 8 and 18 mm. It is thereby ensured that a constriction of the air passage that is sufficient to control the airflows is still available underneath the lower nipper plate, also over the rear region of the guide element 7*a*, wherein a collision of the guide element with the lower nipper plate is ruled out.

A third guide surface f3 is provided following the second guide surface f2 and forms an angle 3 between 90° and 120° with the second guide surface f2. The third guide surface f3 (f3') leads into the base surface GF (GF') of the guide element 7*a* (7*b*). A radius r2 of 5 to 15 mm is provided at the transition from the second guide surface f2 to the third guide surface f3 for the reasons described above. As the schematic view X according to FIG. 2 shows in FIG. 3, the longitudinal direction LR of the guide element 7*a* (7*b*) extends across the width B of the circular comb R and has a width b, which corresponds to the width b of the comb segment G. By installing the proposed guide element 7*b*, uncontrolled airflows can be avoided in the region in which the piecing takes place. In particular, the end of the fed-back fibrous web is prevented from lifting off the peripheral surface of the lower detaching roller before the piecing process takes place.

One possible installation of another guide element 7*b* is shown as a dash-dotted depiction, said guide element being installed in front—as viewed in the comb direction L—of the comb clothing G or in front of the outer section 23 of the basic body 20. The outer shape of the guide element 7*b* corresponds to that of the guide element 7*a* described above and is fastened on a connecting piece R1 of the basic body 20 on the opposite side, as a mirror image. The guide element 7*b* also has three guide surfaces f1' to f3', which extend toward one another at the angles α and β described above. The length l1' of the first guide surface f1' can also be between 5 and 20 mm, whereas the length l2' of the second guide surface f2 can be 20 to 50 mm. Radii r1 and r2 are also provided at the transitions between the guide surfaces f1'-f3' for the reasons described above.

The clearance e' between the enclosing circle HK and the first guide surface f1' is between 4 and 10 mm, whereas the radial clearance M between the end H' of the second guide surface f2' and the enclosing circle HK is between 8 and 18 mm. The guide element 7*b* can be fastened on the basic body 20 similar to the fastening of the guide element 7*a* described above.

By means of the additionally installed second guide element 7*b* having the correspondingly arranged guide surfaces f2' and f1', the end of the fiber tuft FB is already oriented and prepared for entry into the comb segment G such that an abrupt deflection of the fiber tuft upon entry into the comb clothing is avoided.

Fiber damage can be avoided as a result. The use of the additional guide element also has advantageous effects in terms of a controlled airflow in the region between the nipper and the detaching rollers AW.

Modifications and variations can be made to the embodiments illustrated or described herein without departing from the scope and spirit of the invention as set forth in the appended claims.

The invention claimed is:

1. A circular comb (R) for a comber, comprising:

a basic body (18, 20) fastened on a circular comb shaft (15) in a rotationally locked manner;

a comb clothing (G) supported on an outer circumference of the basic body, the comb clothing comprising clothing tips that define an outer enclosing circle (HK);

a guide element (7, 7*a*) following the basic body viewed in a combing direction of the comb clothing, the guide element comprising a first guide surface (f1) that adjoins the basic body (18, 20), is arranged within the enclosing circle (HK) and has a radial clearance (e) from the enclosing circle, the guide element comprising a second guide surface (f2) that adjoins and forms an obtuse angle (α) with the first guide surface (f1);

the radial clearance (e) being between 4-10 mm;

the obtuse angle (a) being between 130°-170°;

a rear end (H) of the second guide surface (f2) having a radial clearance (M) between 8-18 mm from the enclosing circle (HK); and a length (l2) of the second guide surface (f2) being at least twice as great as a length (l1) of the first guide surface (f1), as viewed in a circumferential direction of the circular comb (R).

2. The circular comb according to claim 1, wherein the first guide surface (f1) has a length (l1) between 5-20 mm.

3. The circular comb according to claim 1, wherein the second guide surface (f2) has a length (l2) between 20-50 mm.

4. The circular comb according to claim 1, comprising a radius (r1) of between 5-15 mm provided at a transition of the first guide surface to the second guide surface.

5. The circular comb according to claim 1, further comprising a third guide surface (f3) adjoining the rear end (H) of the second guide surface (f2) and forming an angle (β) between 90°-120° with the second guide surface (f2), and an end of the third guide surface (f3) points in a direction to the circular comb shaft (15).

6. The circular comb according to claim 5, comprising a radius (r2) between 5-15 mm provided at a transition of the second guide surface to the third guide surface.

7. The circular comb according to claim 1, further comprising an additional guide element (7*b*) is installed directly in front of the basic body (20) viewed in a combing direction of the comb clothing, the additional guide element further comprising:

an additional first guide surface (f1') that adjoins the basic body and is arranged within the enclosing circle (HK) with a clearance (e') between 4-10 mm from the enclosing circle (HK);

an additional second guide (f2') adjoining and forming an obtuse angle (α) between 130°-170° with the additional first guide surface (f1');

a front end (H') viewed in the combing direction (L) of the comb clothing (G) of the additional second guide surface (f2') located with a radial clearance (M) between 8-18 mm from the enclosing circle (HK); and a length (l2') of the additional second guide surface (f2') being at least twice as great as a length (l1') of the additional first guide surface (f1'), as viewed in the circumferential direction of the circular comb (R).

8. The circular comb according to claim 7, wherein the additional guide element (7*b*) comprises a third additional guide surface (f3') as viewed in the circumferential direction of the circular comb (R) that adjoins the end (H') of the additional second guide surface (f2') and forms an angle (β) between 90°-120° with the additional second guide surface (f2'), an end of the additional third guide surface (f3') pointing in a direction to the circular comb shaft (15).

9. The circular comb according to claim 7, comprising a radius (r1, r2) between 5-15 mm provided at a transition between the additional first guide surface to the additional second guide surface, and at a transition between the additional second guide surface to the additional third guide surface.

10. The circular comb according to claim 1, wherein the guide element (7*a*) is made from aluminum or a plastic.

11. The circular comb according to claim 1, wherein the first and second guide surfaces comprise a surface to which fibers do not adhere.

12. The circular comb according to claim 1, wherein the guide element (7*a*) is integrally connected to the basic body (20).

* * * * *